US006382466B1

(12) United States Patent
Schneider et al.

(10) Patent No.: US 6,382,466 B1
(45) Date of Patent: May 7, 2002

(54) DEVICE FOR DISPENSING FLOWABLE MATERIALS FROM A PLURALITY OF CARTRIDGE ASSEMBLIES

(75) Inventors: Mark C. Schneider, Moorestown; Joseph B. Hanni, Cherry Hill, both of NJ (US)

(73) Assignee: Albion Engineering Company, Philadelphia, PA (US)

( * ) Notice: Subject to any disclaimer, the term of this patent is extended or adjusted under 35 U.S.C. 154(b) by 0 days.

(21) Appl. No.: 09/938,109

(22) Filed: Aug. 23, 2001

(51) Int. Cl.[7] ..... B67D 5/00

(52) U.S. Cl. ..... 222/137; 222/145.1; 222/80; 222/327; 222/391

(58) Field of Search ..... 222/145.1, 145.3, 222/145.4, 145.5, 145.6, 80, 137, 327, 391

(56) References Cited

U.S. PATENT DOCUMENTS

| | | | | |
|---|---|---|---|---|
| 4,366,919 A | | 1/1983 | Anderson | |
| 4,493,436 A | | 1/1985 | Brokaw | |
| 4,690,306 A | | 9/1987 | Staheli | |
| 4,691,845 A | | 9/1987 | Schwartz | |
| 5,050,774 A | | 9/1991 | Camm et al. | |
| 5,104,005 A | | 4/1992 | Schneider, Jr. et al. | |
| 5,209,376 A | * | 5/1993 | Dirksing | 222/80 |
| 5,330,074 A | | 7/1994 | Wirsig et al. | |
| 5,375,740 A | | 12/1994 | Umetsu et al. | |
| 5,564,598 A | | 10/1996 | Camm et al. | |
| 6,012,610 A | * | 1/2000 | Pauser et al. | 222/88 |
| 6,299,022 B1 | * | 10/2001 | Bublewitz et al. | 222/83.5 |

FOREIGN PATENT DOCUMENTS

| | | |
|---|---|---|
| WO | WO 00/71463 | 11/2000 |

* cited by examiner

*Primary Examiner*—J. Casimer Jacyna
(74) *Attorney, Agent, or Firm*—Caesar, Rivise, Bernstein, Cohen & Pokotilow, Ltd.

(57) ABSTRACT

A device and method for dispensing flowable materials from a plurality of cartridge assemblies. Under the preferred embodiment, the device comprises a receptacle for carrying a plurality of cartridge assemblies therein. The cartridge assemblies each have a longitudinal axis and include a dispensing nozzle and an elongated tubular wall portion for containing a flowable material therein for dispensing. The wall portion is formed of a material that can be cut by a cutting surface. A drive mechanism is provided for moving an elongate drive rod in a direction parallel to the longitudinal axis. A web assembly is secured to the drive rod, the web assembly including a plurality of ejectors extending therefrom. Each ejector is arranged for reciprocal movement along the longitudinal axis within one of the cartridge assemblies between a forward ejecting direction to dispense the flowable material it contains and a return direction. There is disposed on the web assembly at least one cutting surface for slicing the tubular side wall of the cartridge assembly as the ejector moves in the forward ejecting direction.

21 Claims, 15 Drawing Sheets

FIG.9
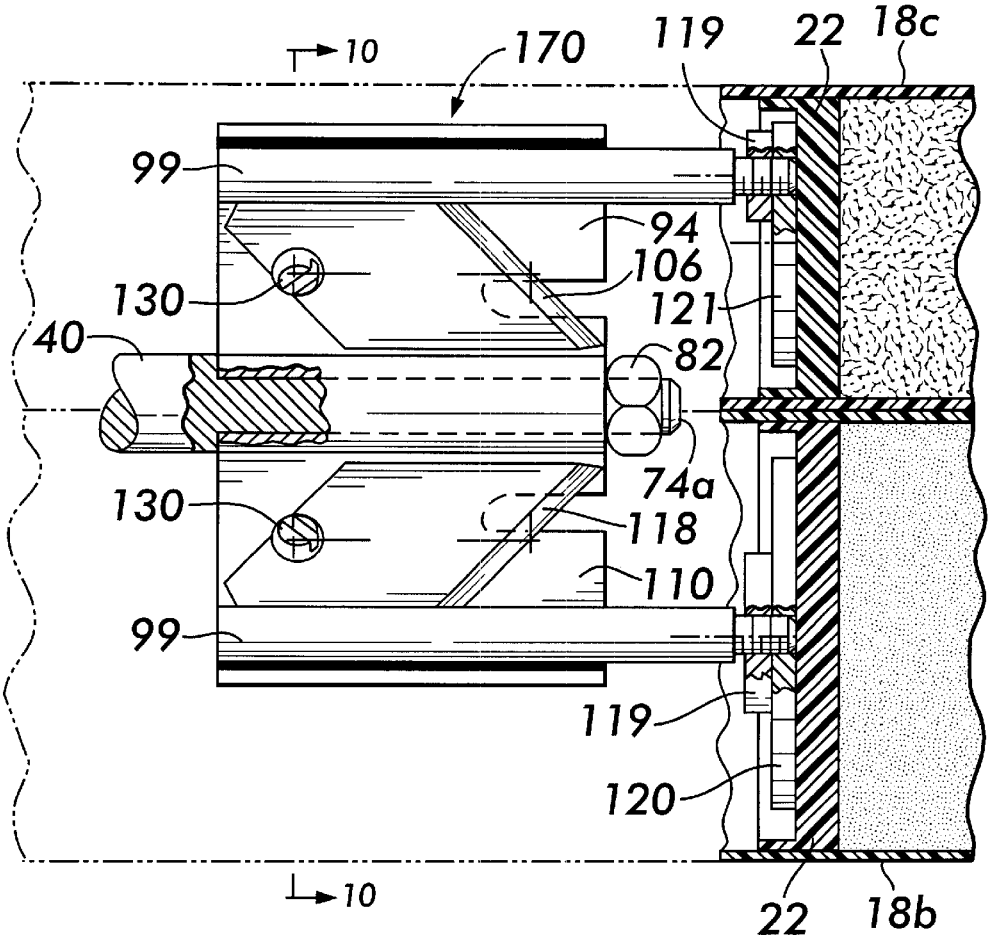
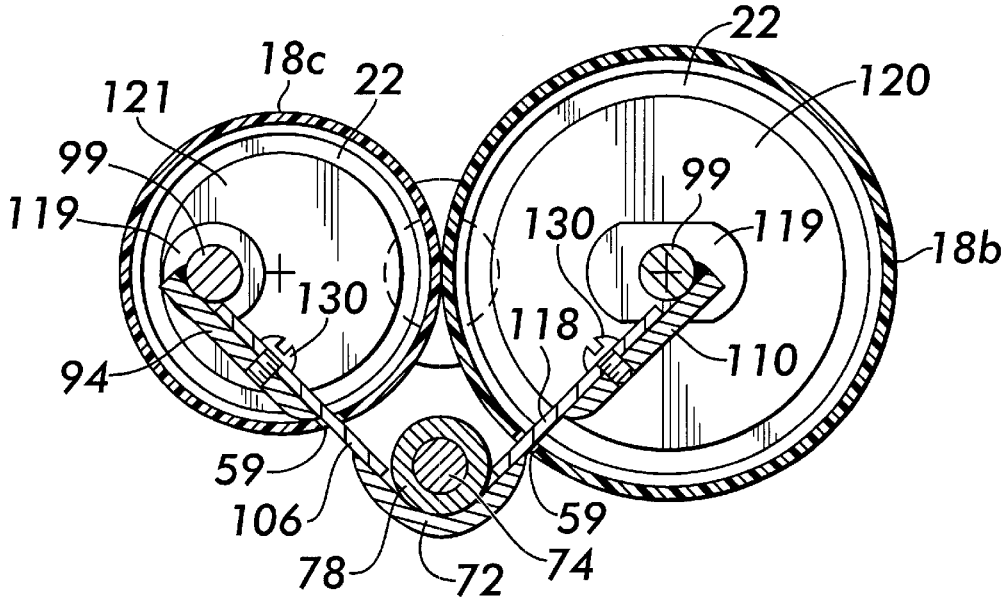
FIG.10

FIG.12
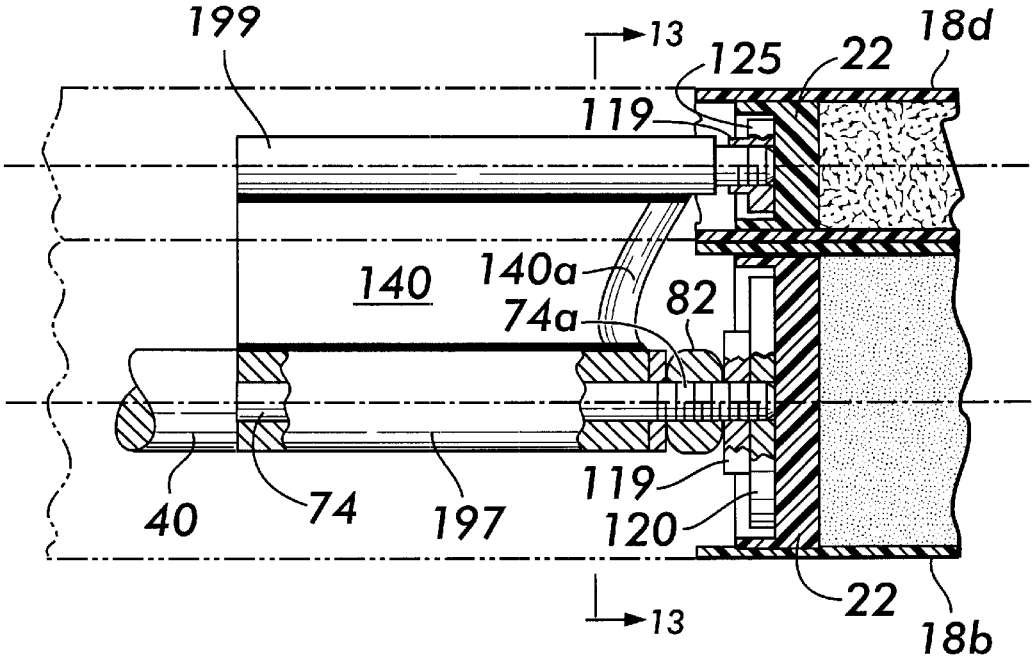
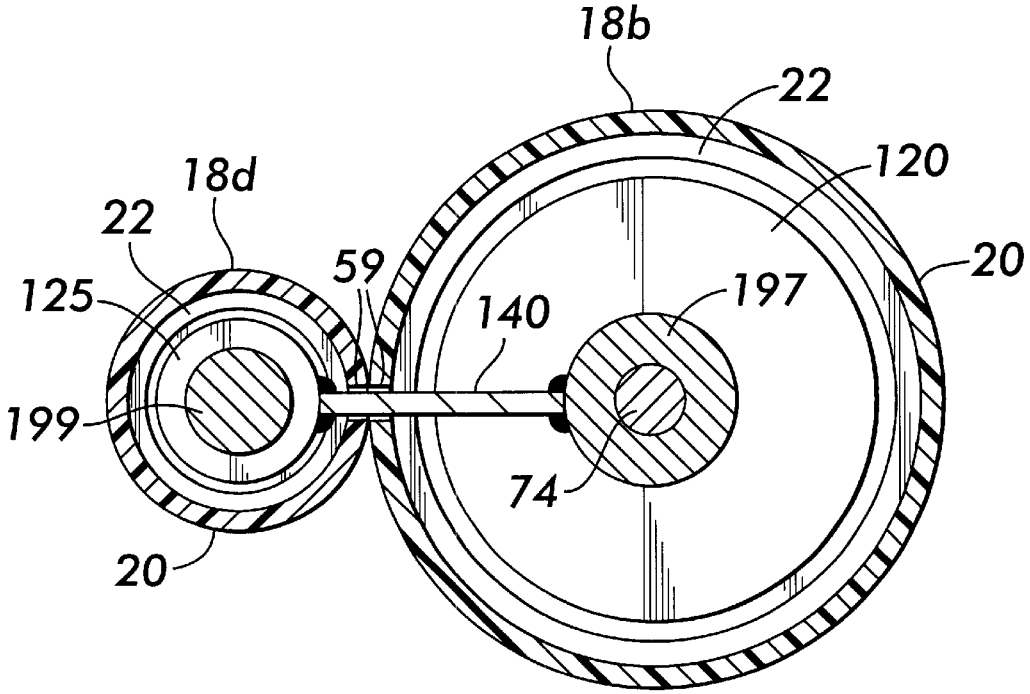
FIG.13

FIG.16
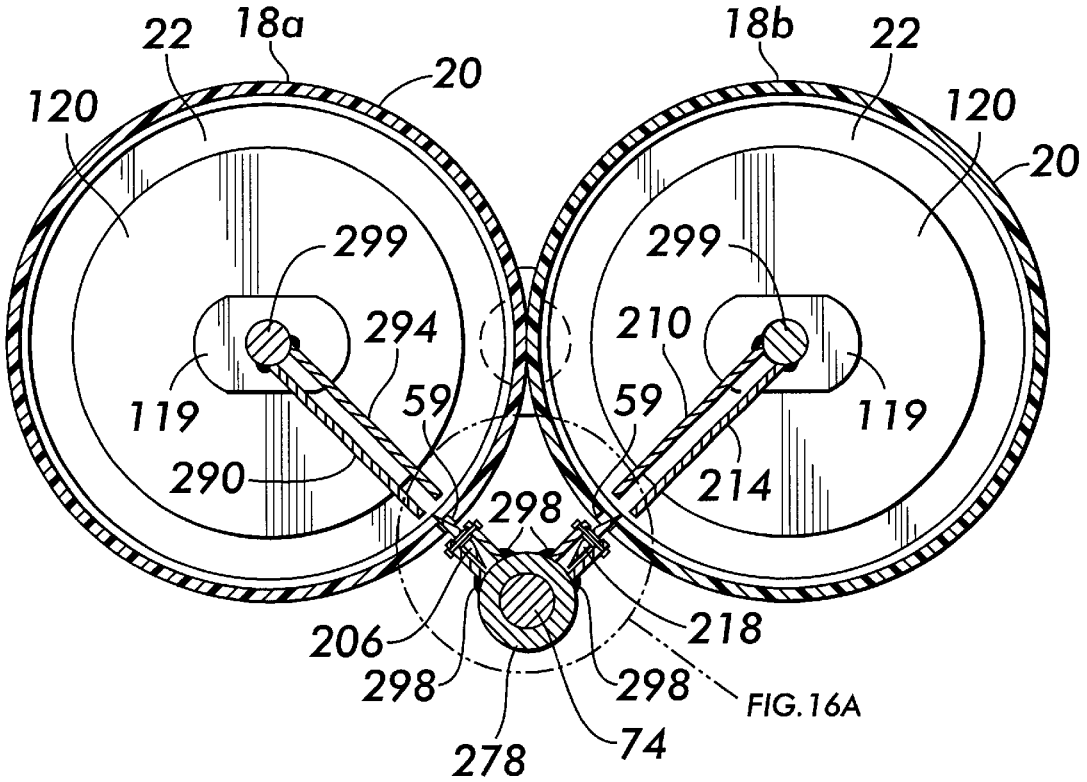
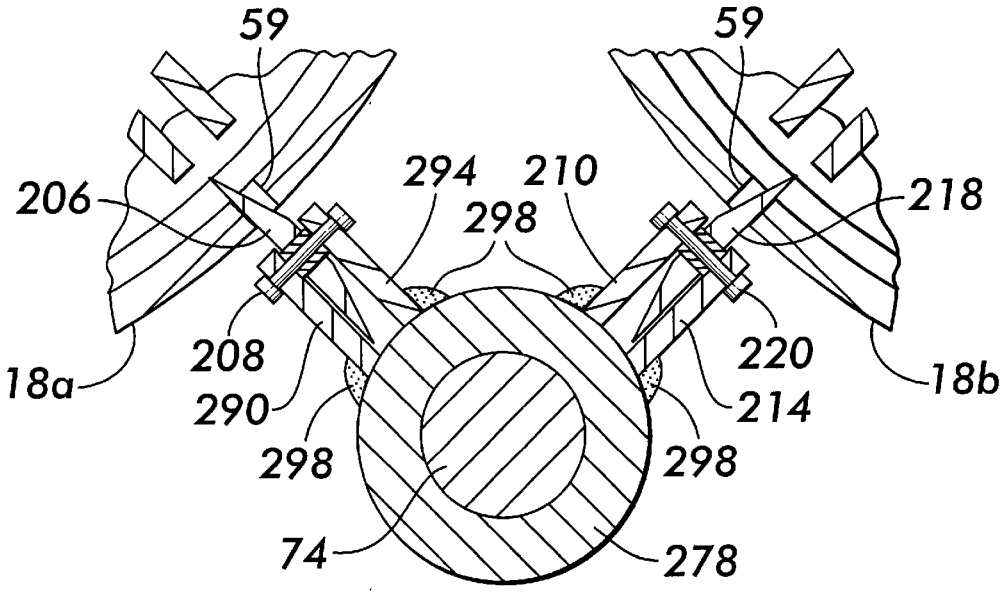
FIG.16A

DEVICE FOR DISPENSING FLOWABLE MATERIALS FROM A PLURALITY OF CARTRIDGE ASSEMBLIES

SPECIFICATION

BACKGROUND OF THE INVENTION

The present invention relates to dispensing devices and, more particularly, to dispensing devices of the type often employing dual component cartridges and dual actuating ejector rams for dispensing dual component materials which cannot be mixed until immediately prior to use. Typical examples of such materials are epoxy resin compositions which are mixed when used with a hardener component which causes subsequent curing of the resin. Viscous materials such as caulks and adhesives are also commonly dispensed from disposable cartridges of standard configuration and standard sizes used in conjunction with dual component dispensing devices which are designed to accept such cartridges.

The cartridges comprise a tubular cylindrical body containing material to be dispensed, a movable plunger at the rearward end of the body retaining the material within the body and providing the means for a dispensing device to apply dispensing pressure to the contents of the cartridges, and an integral or detachable dispensing nozzle at the other end of the body. Some of these materials are of different viscosities which create uneven ejection pressures on the ejection rams. Some of the materials are very thick and difficult to eject and require considerable ejection ram pressure, e.g., 1100 pounds or 2500 pounds of thrust. Alternatively, one or both of the dual component cartridges may contain a low viscosity material. Often the overall diameter of dual component cartridges differ.

The dual component dispensing devices available in the prior art suffer from drawbacks as will be described with reference to FIGS. 1 and 1A. Referring now to FIG. 1A, a prior art dual component dispensing gun is loaded with two cartridge assemblies A and B, each containing one component of a dual component material, each component having a different viscosity. In operation, the trigger C (FIG. 1) is pulled toward the hand grip D (FIG. 1) which causes a drive shaft E which is disposed through the drive mechanism to be incrementally advanced in a forward direction. Likewise, push rods F and G, connected to the drive shaft E, are incrementally advanced in a forward direction within the cartridge assemblies. The push rods F and G engage cup-shaped plungers A' and B' forming a portion of the cartridges A and B and located within the cartridges at the rear portions thereof. Pressure exerted by the push rods F and G upon the plungers A' and B' forces the components outwardly through a nozzle H. Although both push rods F and G apply equal force upon the plungers A' and B', respectively, the push rod F actually travels at a slower rate of speed than the push rod G (and thus, travels less distance in the same amount of time as indicated by vertical line I) due to the fact that the component contained by cartridge A has a greater viscosity than the component contained by cartridge B. Likewise, the push rod G travels at a greater rate of speed than push rod F due to the lower viscosity of component contained by cartridge B (as indicated by vertical line J). Because the two push rods F and G travel at different rates of speed, they apply uneven forces on the dispensing device which results in a lateral flexing of the push rods F and G as indicated by lines K and L. Ultimately, the component of cartridge B will be completely dispensed before the dispensing of the component of cartridge A has been completed. In many cases, this lateral flexing is visually perceptible and usually adversely affects operation of the dispensing device which can result in improper mixing of the components. This drawback only worsens as greater dispensing pressure is required.

Further, as illustrated in FIG. 1, due to the fact that the push rods F and G are located above the drive shaft E and connected to the drive shaft at the rear portion thereof, pressure applied to the push rods F and G during dispensing results in an undesirable downward bending of the push rods F and G which adversely affects operation of the dispensing device. The downward bending, illustrated by line M in FIG. 1, only increases where increased dispensing pressures are required.

In addition, in the event dispensing material contained within the cartridges A and/or B should flow back behind either of the plungers A' and B', the push rods F and G will become contaminated with dispensing material thus requiring replacement of these push rods. The foregoing problems of conventional prior art dispensing devices are addressed in the dispensing device of the present invention which substantially reduces any lateral or vertical flexing of push rods and also eliminates the other drawbacks mentioned above.

SUMMARY OF THE INVENTION

These and other objects of this invention are achieved by providing a device and method for dispensing flowable materials from a plurality of cartridge assemblies. Under the preferred embodiment, the device comprises a receptacle for carrying a plurality of cartridge assemblies therein. The cartridge assemblies each have a longitudinal axis and include a dispensing nozzle and an elongated tubular wall portion for containing a flowable material therein for dispensing. The wall portion of the cartridge assemblies is formed of a material that can be cut by a cutting surface. A drive mechanism is provided for moving an elongate drive rod in a direction parallel to the longitudinal axis. A web assembly is secured to the drive rod, the web assembly including a plurality of ejectors extending therefrom. Each ejector is arranged for reciprocal movement along the longitudinal axis within one of the cartridge assemblies between a forward ejecting direction to dispense the flowable material from within the cartridge assembly and a return direction. There is disposed on the web assembly at least one cutting surface for slicing the tubular side wall of the cartridge assembly as the ejector moves in the forward ejecting direction. In a variation of the preferred embodiment, the ejectors are circular and have substantially the same outer diameter.

In another variation of the preferred embodiment, the ejectors have differing overall diameters.

In another variation of the preferred embodiment, the dispensing device includes at least one cutting surface that is oriented at an angle relative to the wall portion of the cartridge assembly.

In another variation of the preferred embodiment, the web assembly is V-shaped and comprises two flanges, each flange comprising a pair of plates oriented parallel to each other and being spaced apart. Under this variation, a cutting surface is affixed between each pair of plates.

In another variation of the preferred embodiment, the cutting surface is affixed between the plates by welding.

In a second embodiment of the present invention, the cutting surface is affixed to the web assembly by means of a screw.

In a variation of the second embodiment, the ejectors have differing outer diameters and may be centrally mounted or mounted in an offset manner to the web assembly.

In a third embodiment of the present invention, the web assembly comprises a forward edge that has been formed into a cutting surface.

In a variation of the third embodiment, the ejectors have different outer diameters.

In another variation of the third embodiment, two cartridge assemblies are carried by the dispensing device and the single cutting surface is arranged for slicing the tubular side wall of both cartridge assemblies.

In a fourth embodiment of the present invention, the cutting surface is circular in shape and rotatably mounted to the flange assembly.

DESCRIPTION OF THE DRAWINGS

The objects and many attendant features of this invention will become readily appreciated as the same becomes better understood by reference to the following detailed description when considered in connection with the accompanying drawings wherein:

FIG. 9 is an enlarged top view of the web assembly of FIG. 8 illustrating cutting surfaces mounted thereon;

FIG. 10 is an enlarged, sectional view taken along line 10—10 of FIG. 9 and rotated 90 degrees;

FIG. 12 is an enlarged top view of the web assembly of FIG. 11 illustrating the cutting surface formed in the front edge of the web assembly;

FIG. 13 is an enlarged, sectional view taken along line 13—13 of FIG. 12 and rotated 90 degrees;

FIG. 16 is an enlarged, sectional view taken along line 16—16 of FIG. 15 and rotated 90 degrees; and, FIG. 16A is an enlargement of the area encircled and labeled as FIG. 16A in FIG. 15.

DESCRIPTION OF THE PREFERRED EMBODIMENT

Figure 1:
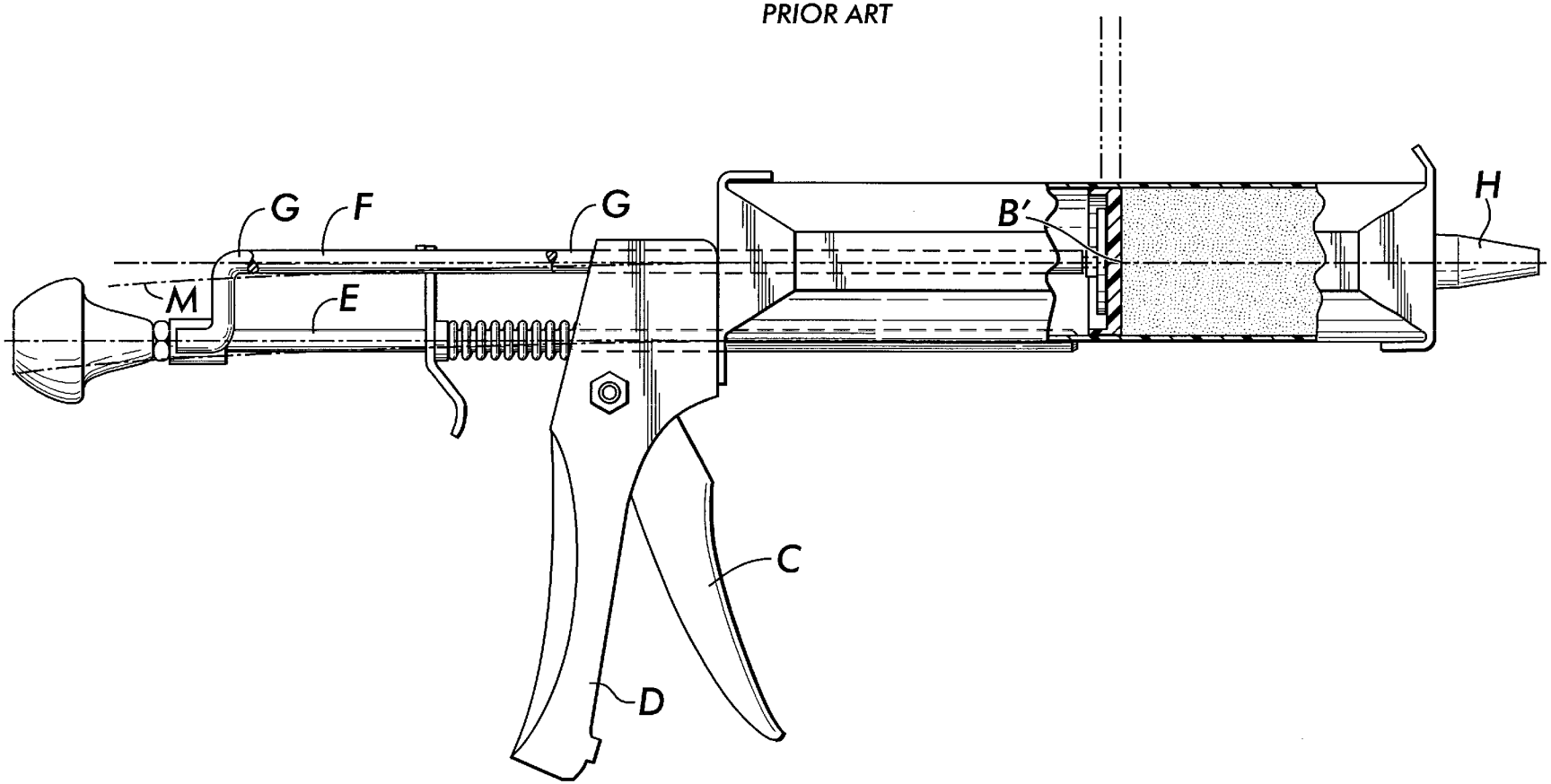
FIG.1 PRIOR ART
FIG. 1 is a side view of a prior art device for dispensing flowable components from multiple dispensing cartridges simultaneously.
Figure 1A:
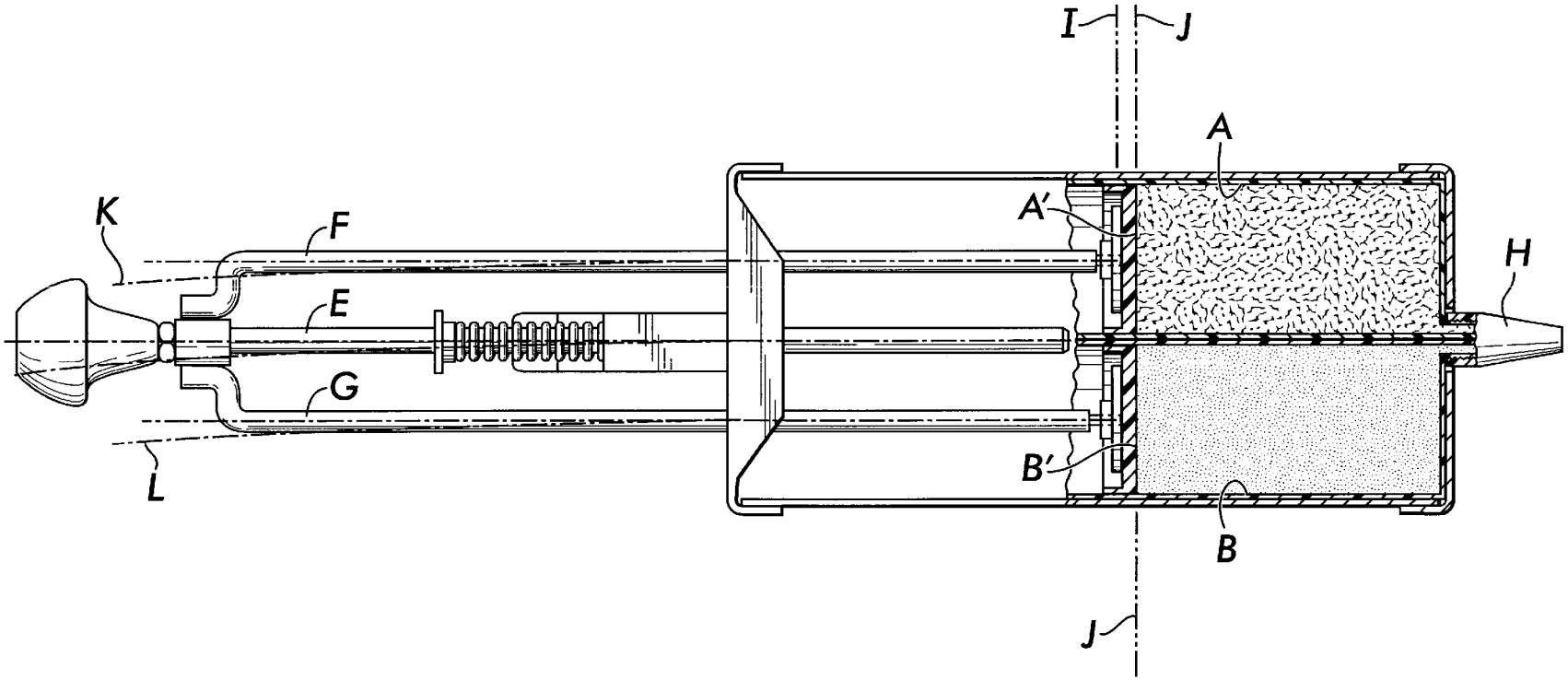
FIG.1A PRIOR ART
FIG. 1A is a top view of the prior art dispensing device of FIG. 1.
Figure 2:
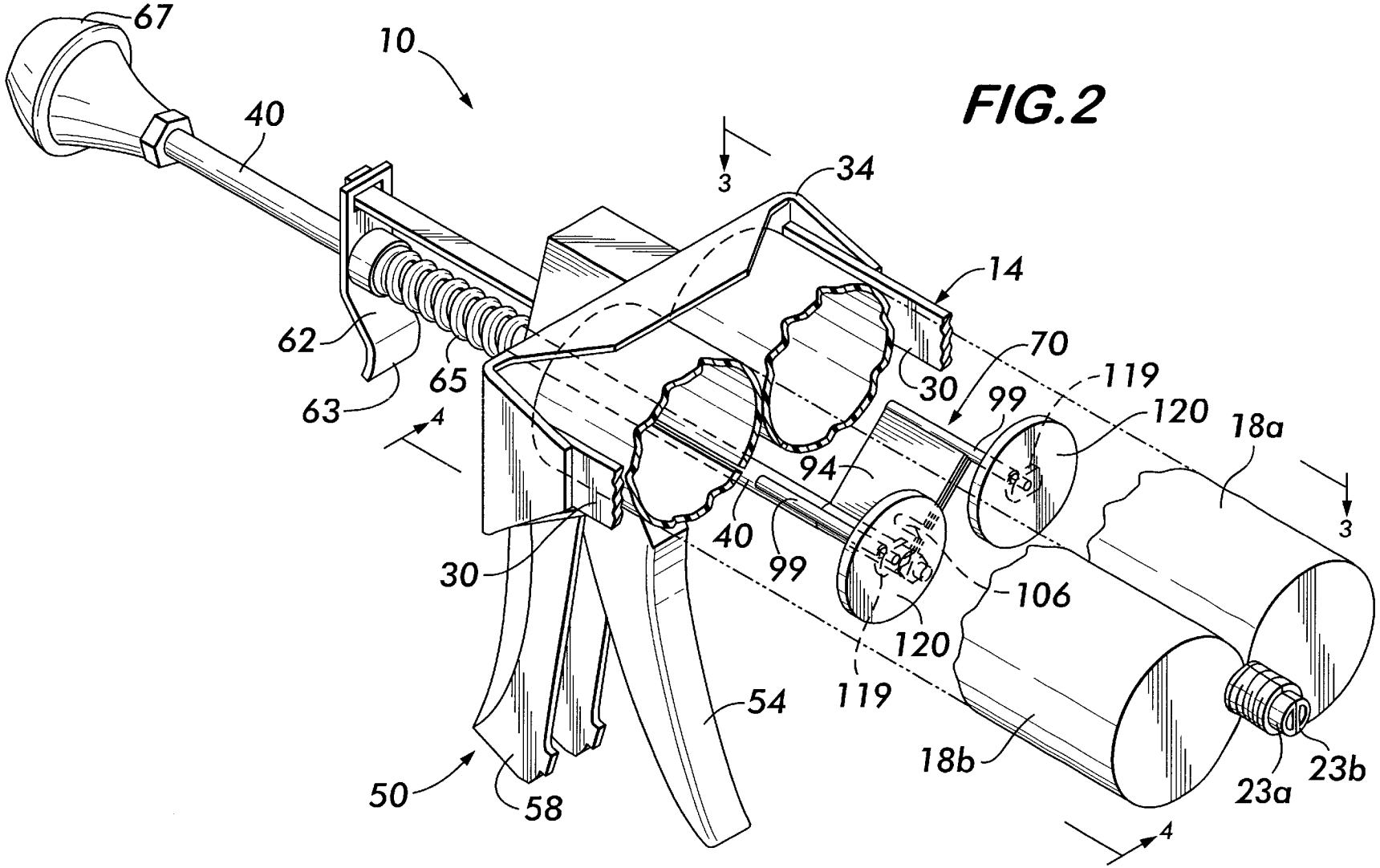
FIG. 2 is an isometric view, partially in section, of a preferred embodiment of the dispensing device of the present invention.
Figure 3:
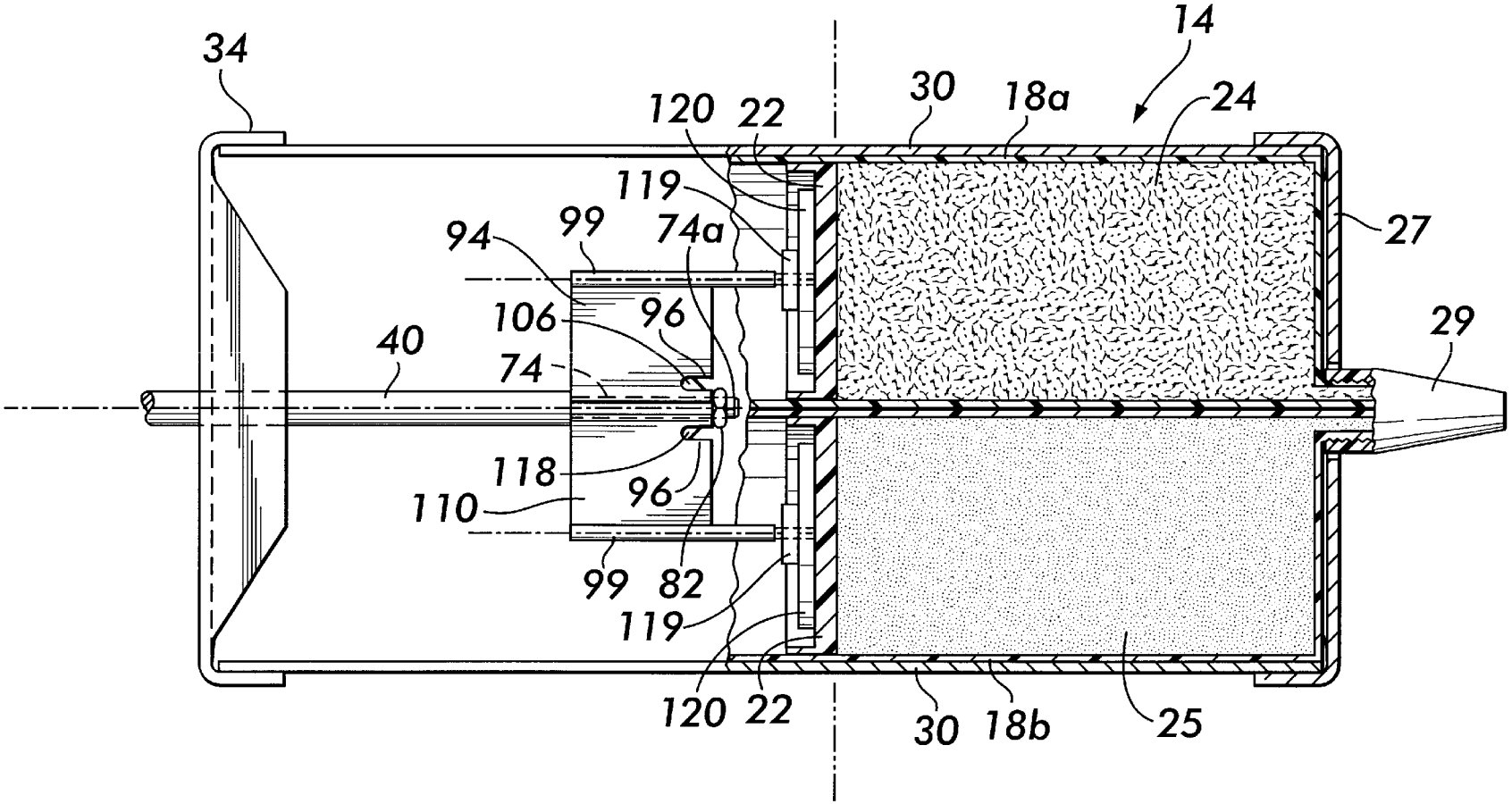
FIG. 3 is an enlarged, sectional view taken along line 3—3 of FIG. 2.
Figure 4:
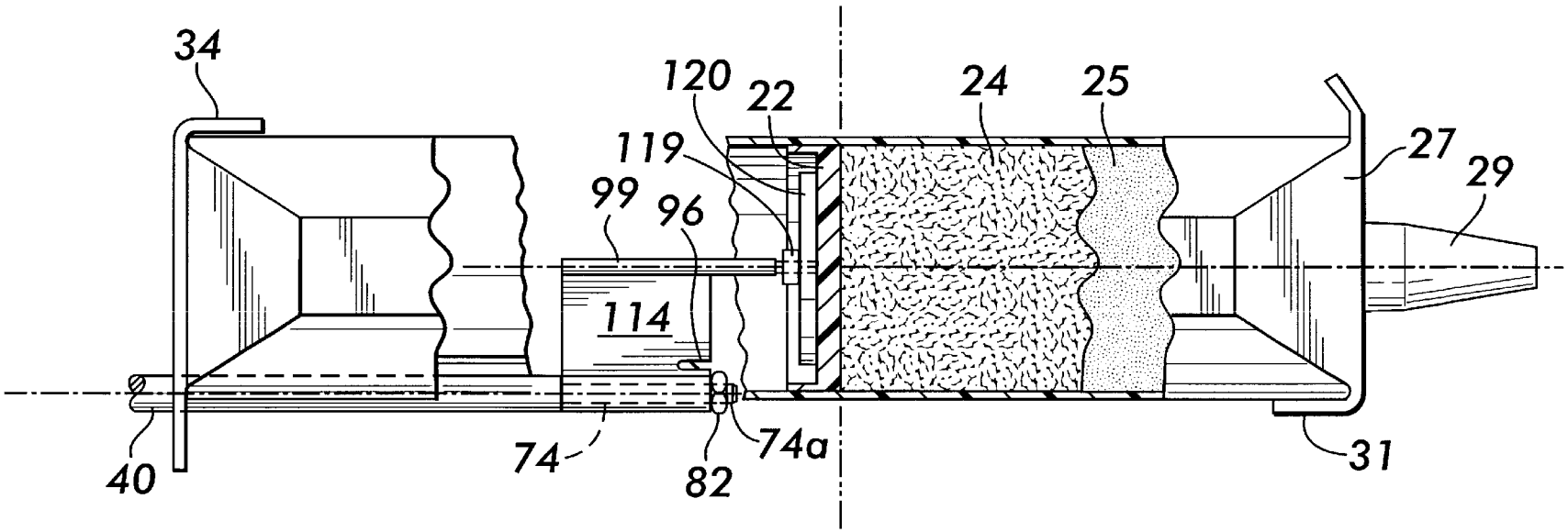
FIG. 4 is an enlarged, sectional view taken along line 4—4 of FIG. 2.
Figure 5:
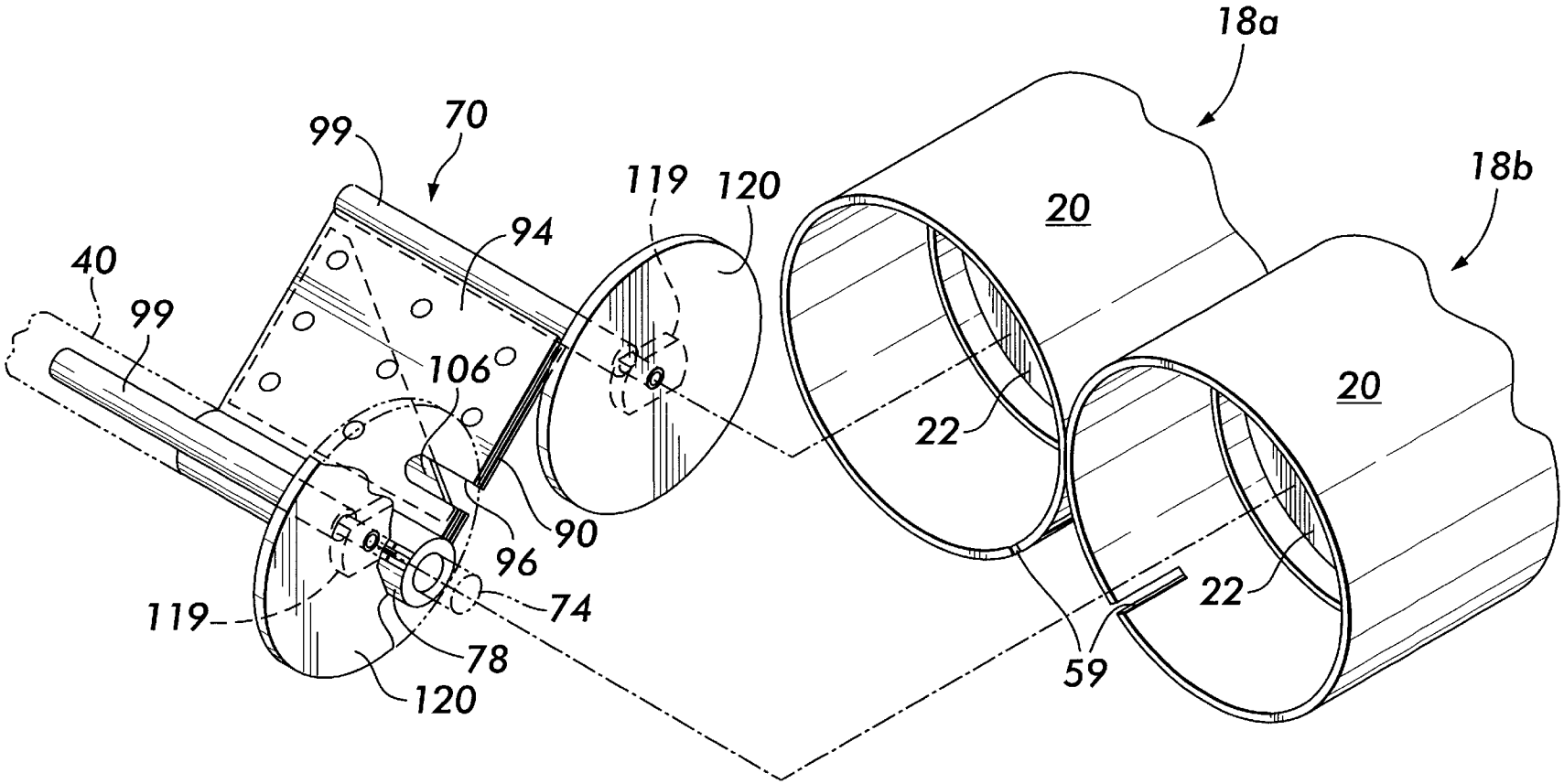
FIG. 5 is an enlarged isometric view of a web assembly portion of the preferred embodiment illustrating a manner for mounting cutting surfaces therein.

Referring now to the drawings, a preferred embodiment of the device for dispensing flowable components from a plurality of cartridge assemblies in accordance with the present invention is shown generally at 10 in FIG. 2. Referring now to FIGS. 2 through 7, the dispensing device 10 includes a forward section in the form of a dual component carriage assembly 14 of conventional design for housing a plurality, e.g., two, cartridge assemblies 18*a* and 18*b* containing components to be dispensed. Often, the cartridge assemblies 18*a* and 18*b* contain components which cannot be mixed until immediately prior to use. Typical examples of such materials are epoxy resin compositions which are mixed when used with a hardener component which causes subsequent curing of the resin. Viscous materials such as caulks are also commonly dispensed from such dual component dispensing devices. As best shown in FIGS. 3–5, the cartridge assemblies 18*a* and 18*b* that are used in conjunction with such dispensing devices are of a standard size and configuration and comprise a tubular cylindrical body portion 20 (FIG. 5) containing material to be dispensed, a cup-shaped movable plunger 22 at the rearward end of the body portion 20, and dispensing nozzles 23*a* and 23*b* (FIG. 2) located at the forward end of the cartridge assemblies 18*a* and 18*b*. The moveable plunger 22 provides means for the dispensing device to apply dispensing pressure to the material 24 and 25 of the cartridge assemblies 18*a* and 18*b*. It should be understood that although the plunger 22 is illustrated as being cup-shaped, these plungers can take other forms, e.g., flat. When the cartridge assemblies 18*a* and 18*b* are appropriately registered within the carriage assembly 14, each moveable plunger 22 is arranged to be moved in a forward ejecting direction towards the nozzles 23*a* and 23*b* to expel material 24 and 25 from the body portions 20.

As best shown in FIG. 2, when the two cartridge assemblies 18*a* and 18*b* are positioned side-by-side, the two semicircular nozzles 23*a* and 23*b* provide a circular threaded nozzle that is adapted to receive a threaded plastic nozzle 29 (FIG. 3). As best illustrated in FIGS. 3 and 4, the components 24, 25 contained within the cartridge assemblies 18*a* and 18*b* may be of different viscosities. The body portion 20, moveable plunger 22 and nozzles 23*a*, 23*b* may be of conventional construction and may be formed of conventional materials such as thin metal, e.g., aluminum, heavy cardboard, plastic, e.g., polyethylene or polypropylene, or other materials that are cuttable by a cutting surface in a manner to be described below. When the two cartridges 18*a* and 18*b* are positioned in a side-by-side relationship within the carriage assembly 14, the two semicircular nozzles 23*a* and 23*b* come into abutting relationship with each other to provide a resulting circular threaded nozzle. Thus, during ejection, the different components contained within each of the cartridges 18*a* and 18*b* are caused to intermix with one another as they are ejected from the nozzle 29. The threaded plastic nozzle 29 may be threaded upon the semicircular nozzles 23*a* and 23*b* to hold the two component cartridge assemblies 18*a* and 18*b* together. Alternatively, the ejection nozzle 29 can be formed as part of the carriage assembly 14, in alignment with the semicircular nozzles 23*a* and 23*b*. Alternatively, the nozzles 23*a* and 23*b* may be positioned away from each other rather than in side-by-side relationship where an application does not involve the mixture of two component materials.

It should be understood that the carriage assembly 14 can be of any desired construction for housing the plurality of cartridge assemblies 18*a* and 18*b* and does not constitute a limitation on the present invention. For example, the carriage assembly 14 could be arranged for housing three or more cartridge assemblies each containing the same or different components to be dispensed.

Referring now to FIGS. 3 and 4, the carriage assembly 14 includes at its forward end a forward support bracket 27 having an opening (not shown) positioned centrally thereof for passage of the semicircular nozzles 23*a* and 23*b* therethrough. The forward support bracket 27 also includes a lower stirrup 31 (FIG. 4) to assist in positioning and retaining the cartridge assemblies 18*a* and 18*b* within the carriage assembly 14. The forward support bracket 27 is joined to a pair of elongate support members 30 by any suitable means, e.g., welding. At its rearward end, the carriage assembly 14 includes a rear support bracket 34 which is also joined to the pair of elongate support members 30 by any suitable means, e.g., welding. The rear support bracket 34 includes an opening (not shown) to permit extension of an elongate drive rod 40 therethrough.

Referring now to FIG. 2, the elongate drive rod 40 extends directly through the trigger mechanism and is incrementally advanced in a forward ejecting direction by a trigger assembly 50. In contrast to the above-discussed prior art mechanism wherein the two push rods extending above the drive rod flex vertically and laterally upon the application of dispensing pressure, under the present arrangement, the elongate drive rod 40 will not flex in either direction upon application of dispensing pressure because it extends directly through the trigger mechanism and utilizes a web assembly for dispensing materials from within the cartridge assemblies in a manner to be discussed below. Mechanisms for incrementally advancing drive rods and piston assemblies are well known in the art. However, by way of example, mechanisms for incrementally advancing the drive rod can be of the type shown and described in U.S. Pat. No. 5,823,403 (Schneider); U.S. Pat. No. 5,370,282 (Sedlmeier); U.S. Pat. No. 5,501,374 (Laufer, et al.) and U.S. Pat. No. 5,390,831 (Schneider), all of which are fully incorporated by reference herein. Further, although the dispensing device illustrated in the figures operates in response to manual actuation, e.g., rachet operation, and does not operate by means of pneumatic or hydraulic pressure or by means of an electric motor, it should be understood that alternatively, the drive rod 40 may be incrementally or continuously advanced by such means. Also, although the elongate drive rod 40 is illustrated as being round, it should be understood that this shape is not limiting and the drive rod 40 may be of shapes other than round, e.g., square, hexagon.

To prevent backward movement of the drive rod 40 following release of the trigger 54, a rear dog 62 of conventional operation is provided. The rear dog 62 includes a passage having edge surfaces (not shown) through which the drive rod 40 extends and includes a finger gripping extension 63 at the lower end thereof. A compression spring 65 is located between and in engagement with the rear of the trigger assembly 50 and with the rear dog 62. It should be noted that the compression spring 65 biases the rear dog 62 in a counterclockwise direction to cause edge surfaces of the passage (not shown) to dig into the elongate drive rod 40 for precluding the drive rod 40 from moving in a direction opposite the ejecting direction upon release of the trigger 54. However, when it is desired to axially adjust the position of the drive rod 40 manually, the finger gripping extension 63 is manually depressed to position the rear dog 62 in a generally vertical orientation to permit free sliding of the drive rod 40 within the passage of the rear dog 62. It should be understood that the arrangement and manner of operation of the rear dog 62 is conventional and does not constitute a limitation on the present invention. Additionally, a return knob 67 located at the proximal end of the elongate drive rod 40 allows the user to withdraw the ejectors 120 from the cartridge assemblies 18*a* and 18*b* after dispensing of the components 24, 25 has been completed or in the event it becomes necessary to replace the ejectors that have become contaminated with dispensing material that has flowed from within the cartridge assemblies back behind the plungers 22 in a manner to be described in detail below. Although the return knob 67 is illustrated in FIG. 2 as being round, it is to be understood that this is not limiting and the return knob 67 can take other shapes, e.g., T-shaped, plural flat sides or square.

Referring again to FIG. 2, it should be understood that the elongate drive rod 40 is driven in the forward ejecting direction by actuation of a trigger 54 in a direction toward the handle 58. The trigger 54 is pivotally mounted to the handle 58 by any suitable means, e.g., a pivot bolt (not shown) passing through the handle 58 and a nut (not shown). It should be understood that the pivot bolt (not shown) could be replaced with a pivot pin (not shown) or any other desired pivot support. The trigger 54 is spring loaded away from the handle 58 by a conventional spring (not shown). The handle 58 is secured to the carriage assembly 14 by any suitable means.

Figure 6:
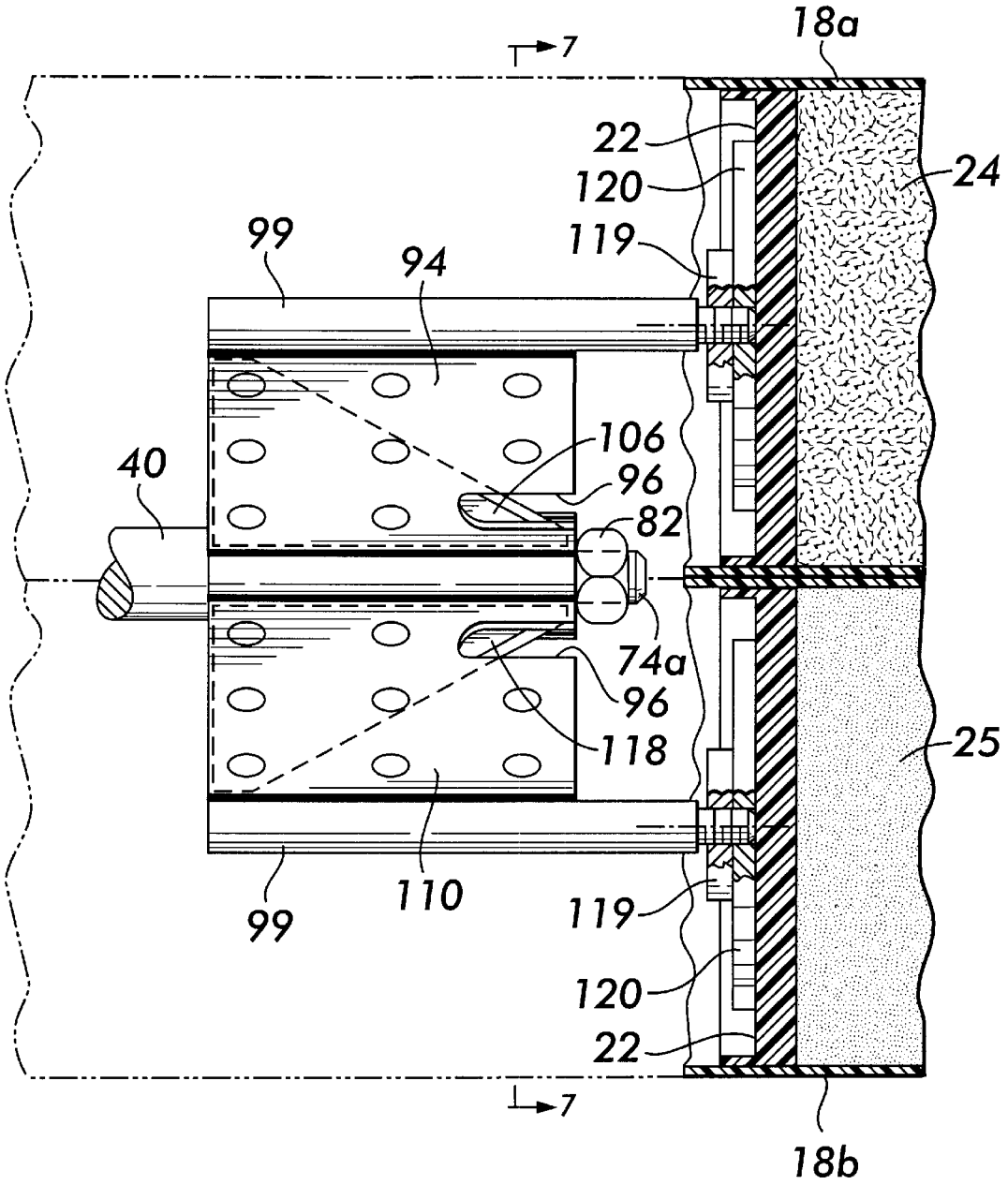
FIG. 6 is an enlarged top view of the web assembly of FIG. 5 illustrating cutting surfaces mounted therein.
Figure 7:
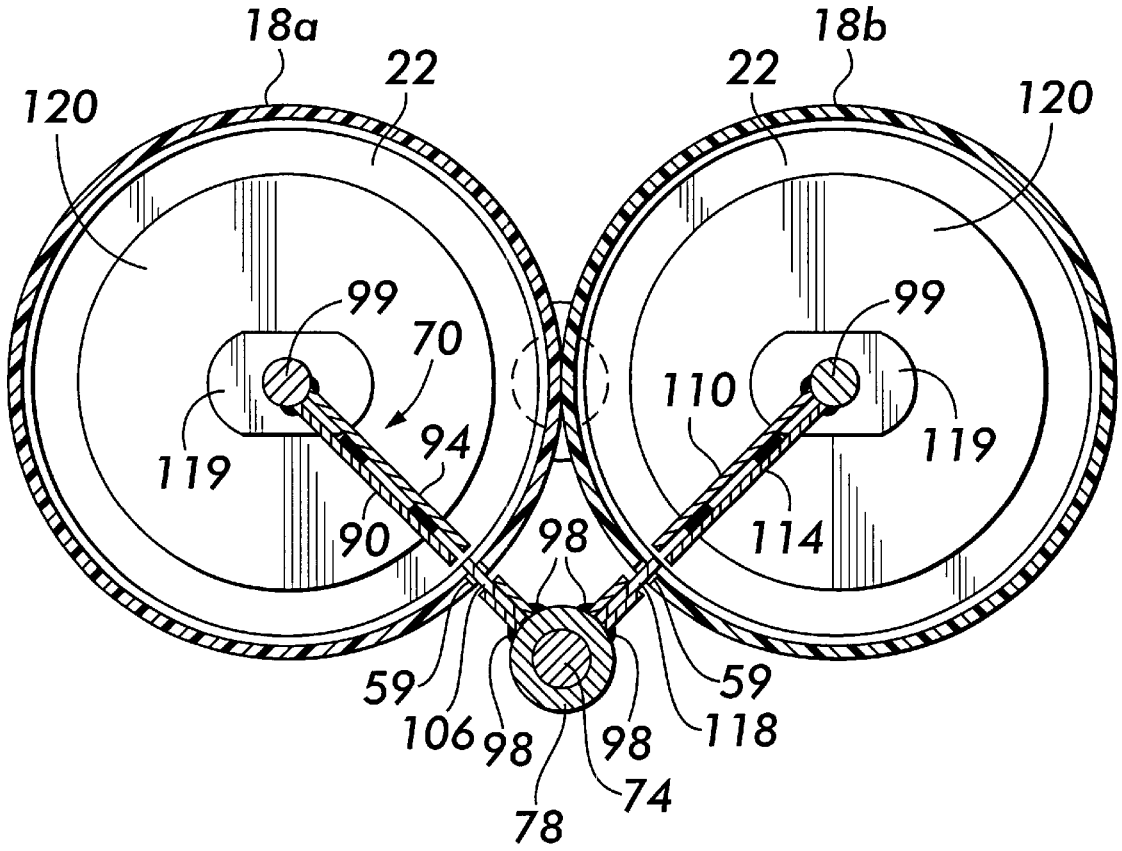
FIG. 7 is an enlarged, sectional view taken along line 7—7 of FIG. 6 and rotated 90 degrees.

Referring now to FIGS. 2–7, a web assembly 70 is mounted to the forward end of the elongate drive rod 40, i.e., the end closest to the cartridge assemblies 18*a* and 18*b*, by any suitable means. For example, as shown in the previously mentioned figures, at its forward end, the diameter of the drive rod 40 reduces at a shoulder. The reduced section of the drive rod 40 is best illustrated in phantom at 74 in FIG. 3. As best seen in FIGS. 5 and 7, the reduced section 74 extends through a central opening located in a base tube 78 of the web assembly 70 and emerges at a free end 74*a* that is threaded. The web assembly 70 is affixed to the elongate drive rod 40 by attachment of a nut 82 to the threaded free end 74*a*. Alternatively, the web assembly 70 could be affixed to the forward end of the elongate drive rod 40 by other means, e.g., a snap, a clip, or any other suitable fastening member. Alternatively, the web assembly 70 could be welded to the forward portion of the drive rod 40 or formed as integral with the drive rod 40. The web assembly 70 may be formed of any suitable material, e.g., metal, plastic, composite, cast, etc.

Referring now to FIGS. 6 and 7, extending upwardly from the base tube 78 at approximately a forty-five degree angle are two sets of flanges that form a generally V-shape. As best seen in FIG. 7, the first set of flanges 90, 94 of similar length, shape and thickness, and oriented parallel to one another in a spaced-apart relationship are welded at their one end to the base tube 78 by fillet welds 98. The flanges 90, 94 extend upwardly at an approximately forty-five degree angle to the left where they are attached by any suitable means, e.g., welding, at their opposite ends to a rod-portion 99. As best seen in FIG. 6, the rod portion 99 extends forward toward the cartridge assemblies and terminates at an ejector 120 attached thereto. The ejector 120 may be affixed to the rod portion 99 by any suitable means. As best shown in FIG. 6, the forward end of each rod portion 99 includes a section that is reduced in diameter and threaded. This section extends through an internally threaded reinforcing weld nut 119 that is welded to the ejector 120 which includes an unthreaded centrally located opening. The ejector is sized to fit within the cup-shaped movable plunger 22 located at the rearward end of the cartridge assembly 18*a*. Likewise, a second set of flanges 110, 114 of similar length, shape and thickness and oriented parallel to one another in a spaced-apart relationship are welded at their one end to the base tube 78 by fillet welds 98 and extend upwardly at an approximately forty-five degree angle to the right where there are attached by any suitable means, e.g., welding, at their opposite ends to a rod portion 99. Referring again to FIG. 6, the rod portion 99 extends forward towards the cartridge assemblies and terminates at an ejector 120 sized to fit within the cup-shaped movable plungers 22 located at the rearward end of the cartridge assembly 18*b*. An internally threaded reinforcing weld nut 119 may be welded to the ejector 120 and threaded over the rod portion 99.

A cutting surface 106 is disposed and secured within the space between the flanges 90 and 94 and is employed to axially sever the tubular body portion 20 of the cartridge assembly 18*a*. Although the cutting surface 106 is shown in FIG. 6 as being secured between the flanges 90 and 94 by welding, it is to be understood that in accordance with the present invention, the cutting surface 106 could be affixed between the flanges 90 and 94 by any suitable means. For example, the cutting surface 106 could be affixed therebetween utilizing a suitable adhesive or bonding material. Alternatively, the cutting surface 106 could be formed as an integral part of the flanges 90 and 94 such as by injection molding. Under yet another alternative, the cutting surface 106 could be affixed between the flanges 90 and 94 by utilizing a punch press to punch a notch or divot in the flanges 90 and 94 to hold the cutting surface 106 therebetween. The cutting surface may be any suitable commercial blade. Several such suitable commercial blades include an X-Acto No.8 or No.24 blade or a Stanley Model No. 11-921 blade. Likewise, a cutting surface 118 is disposed within the space between the flanges 110 and 114, is secured therein by any suitable means, e.g., welding, and is employed to axially sever the tubular body portion 20 of the other cartridge assembly 18*b*. As best shown in FIG. 5, the cutting surfaces 106, 118 are oriented at an angle with respect to the tubular body portion 20 of the cartridge assemblies 18*a* and 18*b* to ease cutting into the tubular body portion 20. The flanges 90, 94 and 110, 114 also include opposed cutouts that form slots indicated at 96 which are arranged for receiving the tubular body portions 20 and guiding them towards the cutting surfaces 106, 118. In this manner, as the ejectors 120 penetrate the interior of the cartridge assemblies 18*a* and 18*b*, the cutting surfaces 106, 118 will cut into the tubular body portions 20 of the cartridge assemblies 18*a* and 18*b* and allow the ejectors 120 to penetrate further into the interior of the cartridge assemblies 18*a* and 18*b* and to prevent interference with operation of the dispensing device.

In operation, with the cartridges 18*a* and 18*b* properly situated within the carriage assembly 14, the trigger 54 is pulled toward the handle 58 which causes the drive rod 40 and ejectors 120 mounted thereto to move in the forward ejecting direction to come into contact with the plungers 22 situated in the rear portion of the cartridge assemblies 18*a* and 18*b*. The ejectors 120 apply force upon the plungers 22 forcing material out of the dispensing nozzles 23*a* and 23*b*. The cut outs 96 are positioned for entry of the tubular body portions 20 therein such that cutting surfaces 106 and 118 cut into the tubular body portions 20 of the cartridge assemblies 18*a* and 18*b* as indicated at 59 in FIG. 5 as the ejectors 120 penetrate further into the interior of the cartridge assemblies 18*a* and 18*b*. Cutting of the tubular body portions 20 enables the ejectors 120 to continue penetrating into the interior of the cartridge assemblies 18*a* and 18*b*. In the event material 24, 25 should flow back behind the plungers 22 during dispensing and contaminate the ejectors 120, the web assembly 70 may be withdrawn from the cartridge assemblies 18*a* and 18*b* by use of the return knob 67. Thereafter, the flange assembly 70 may be detached from the drive rod 40 by removal of the nut 82 and discarded with the cartridge assemblies 18*a* and 18*b*. Thereafter, a new web assembly 70 may be attached to the drive rod 40 and a new cartridge assembly placed into the carriage assembly 14. In this manner, the elongate drive rod 40, which has not entered either of the cartridge assemblies and has not been contaminated with material 24, 25 that has flowed back behind the ejectors 120, can be retained and a new uncontaminated flange assembly 70 attached thereto.

Figure 8:
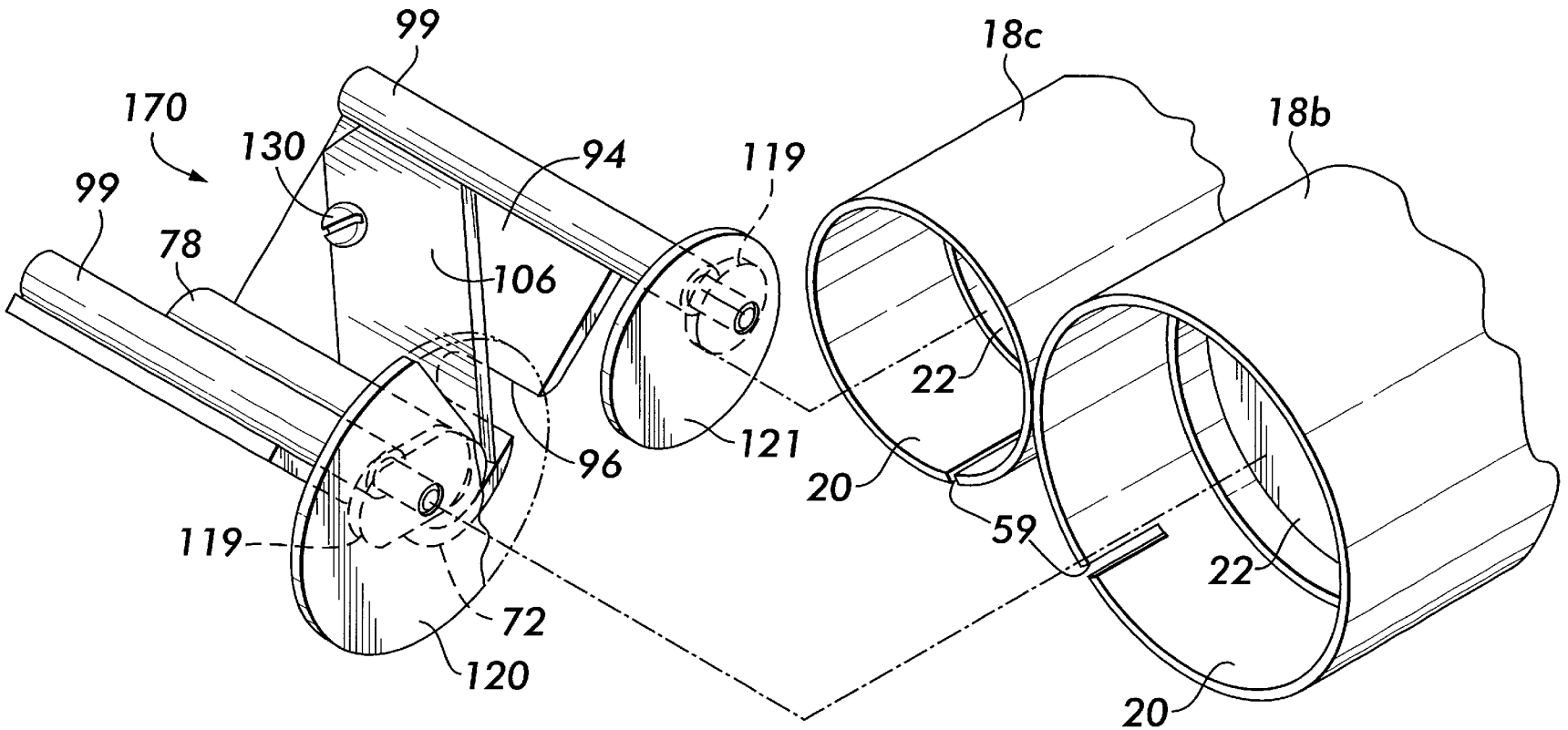
FIG. 8 is an enlarged isometric view of the web assembly portion of a second embodiment of the dispensing device of the present invention illustrating an alternative manner for mounting cutting surfaces thereon, the web assembly including ejectors having different diameters.

FIGS. 8 through 10 show a second embodiment of the present invention wherein like reference numerals designate like parts to that described with reference to FIGS. 1 through 7. Under this embodiment, a web assembly 170 comprises a base tube 78 that is welded to a cradle piece 72. Single flanges 94 and 110, also welded to the cradle piece 72, extend upwardly at approximately forty-five degree angles from the base tube 78 to form a V-shape where they are affixed to rod portions 99 by any suitable means, e.g., welding. Alternatively, the components of the web assembly 170 could be affixed to each other by other suitable means, e.g., screws, or the web assembly 170 could be formed as a unitary structure. A cutting surface 106 is attached to the top surface of the single flange 94 by means of a screw 130 while a cutting surface 118 is attached to the top surface of a single flange 110 also by means of a screw 130. This is an alternative to the arrangement of the preferred embodiment wherein cutting surfaces are affixed between pairs of flanges. Aside from the fact that single flanges 94, 110 are utilized rather than pairs of flanges, the web 170 is substantially the same in overall size and dimensions as the web assembly 70 discussed in connection with the preferred embodiment. Under the preferred embodiment, the cartridge assemblies had substantially equal overall diameters. By contrast, as shown in FIGS. 8–10, the cartridge assembly 18*c* has an overall diameter that is somewhat less than that of the cartridge assembly 18*b*. To accommodate for the differently sized cartridge assemblies, 18*b* and 18*c*, the ejector 121 is sized smaller to fit within the cup-shaped movable plunger 22 of the smaller cartridge assembly 18*c* and is mounted to the rod portion 99 in an offset position (as best shown in FIG. 10). Adjusting the size and mounting position of the ejector 121 increases the versatility of the web assembly for applications where differently sized cartridge assemblies are utilized or where cartridge assemblies have the same overall diameter. The second embodiment operates in substantially the same manner as described in connection with the preferred embodiment, i.e., as the ejectors 120, 121 penetrate the interior of the cartridge assemblies 18*b* and 18*c*, the cutting surfaces 106, 118 will cut into the tubular body portions 20 of the cartridge assemblies 18*b* and 18*c* and allow the ejectors 120 to penetrate further into the interior of the cartridge assemblies 18*b* and 18*c* and to prevent interference with operation of the dispensing device. Cuts created by cutting surfaces 106, 118 are indicated at 59 in FIGS. 8 and 10.

Figure 11:
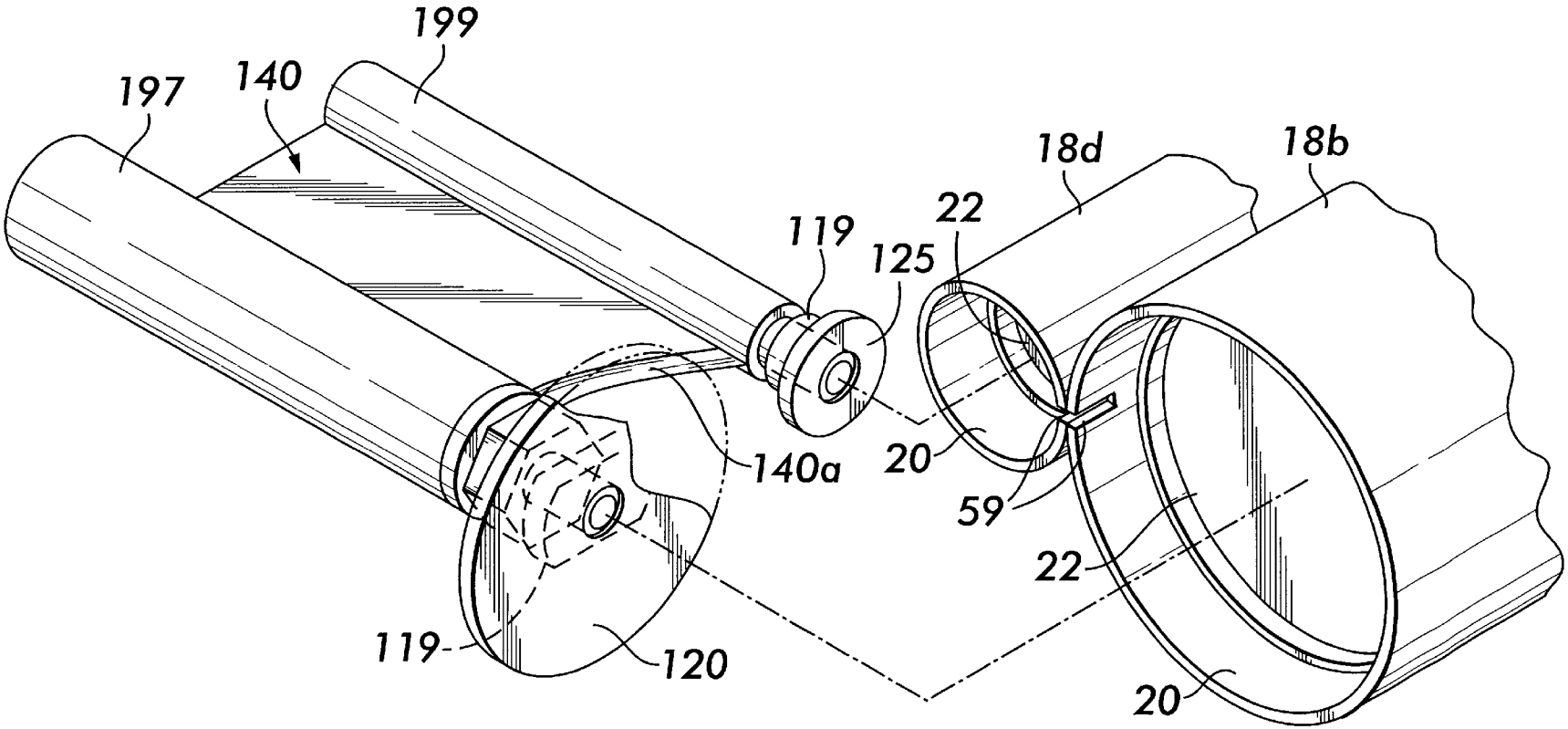
FIG. 11 is an enlarged isometric view of the web assembly of a third embodiment of the dispensing device of the present invention wherein a cutting surface is formed in the front edge of the web assembly, the web assembly including ejectors having different diameters.
Figure 14:
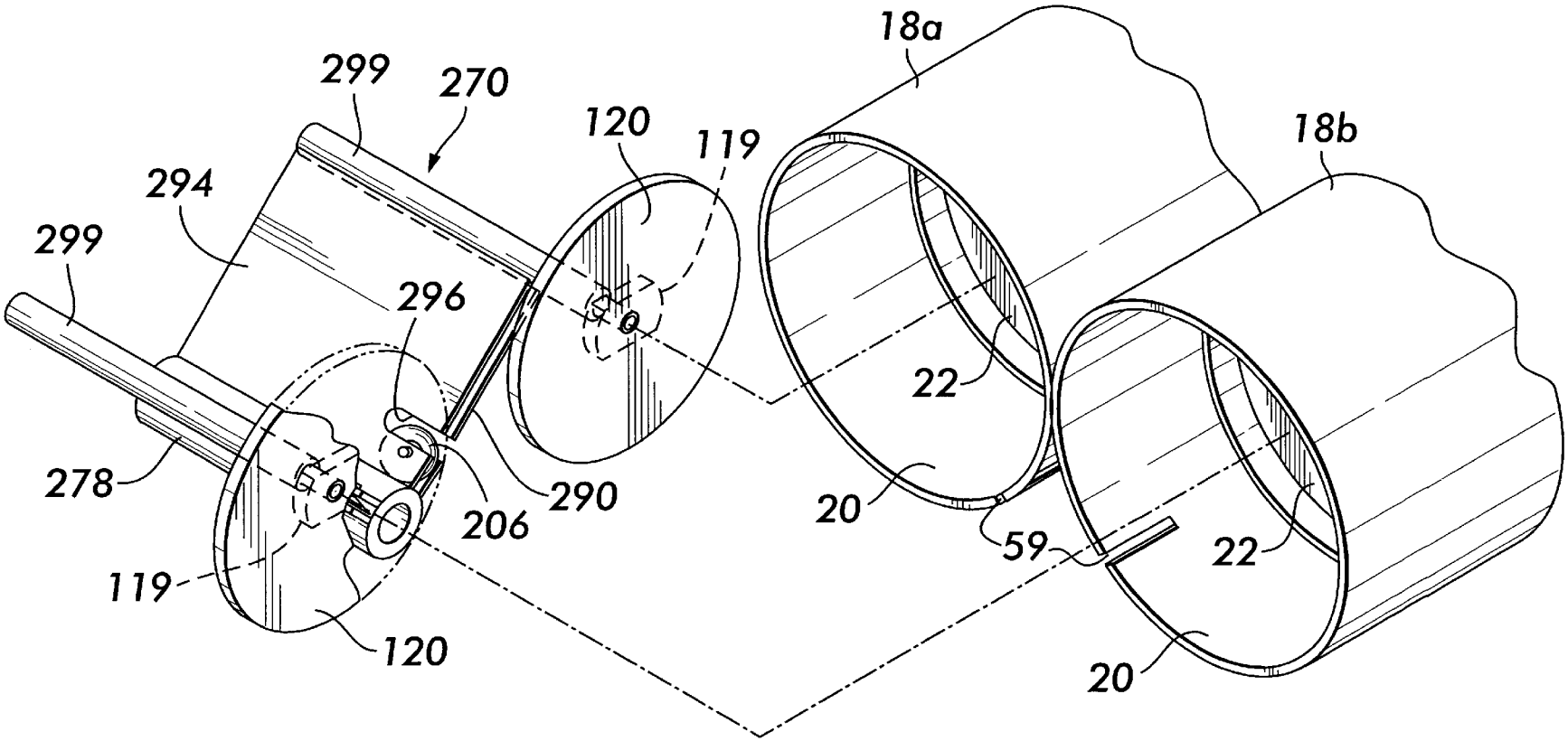
FIG. 14 is an enlarged isometric view of the web assembly of a fourth embodiment of the dispensing device of the present invention illustrating an alternative cutting surface, e.g., a rotary cutting surface or pipe-cutter, mounted within the web assembly.

FIGS. 11–13 show a third embodiment of the present invention wherein like reference numerals designate like parts to that described with reference to FIGS. 1 through 7.

Under this embodiment, rather than utilizing a V-shaped web assembly as disclosed and discussed in the previous two embodiments, a flange 140 that is substantially flat is affixed between a tube portion 197 and a rod portion 199 by any suitable means, e.g., welding. As best shown in FIG. 12, the tube portion 197 is affixed to the forward end of the drive rod 40. Specifically, as the drive rod 40 extends in the forward ejecting direction, its diameter narrows at a shoulder to create a reduced section 74 which extends through a central opening located in the tube portion 197. The reduced section 74 extends through the tube portion 197 and emerges at a free end 74*a* that is threaded. The tube portion 197 is positioned against the shoulder of the drive rod 40 by attachment of a nut 82 to the threaded free end of the reduced section 74. In this manner, the web assembly 170 may be detached from the drive rod 40 in the manner described under the preferred embodiment. Alternatively, the tube portion 197 could be formed integrally with the drive rod 40. Ejector 120 is attached to the forward end of the tube portion 197 and an ejector 125, smaller in overall diameter than the ejector 120, is attached at the forward end of the rod portion 199. An internally threaded reinforcing weld nut 119 may be utilized as required. The ejector 120 is sized and positioned on the tube portion 197 to fit within the cup-shaped movable plunger 22 located at the rearward end of the cartridge assembly 18*b* and the ejector 125 is sized and positioned on the rod portion 199 to fit within the cup-shaped movable plunger 22 located at the rearward end of the cartridge assembly 18*d*.

At its forward end, the flange 140 includes a canted or angled edge that is formed into a cutting surface 140*a* to ease cutting into the tubular wall 20 of the cartridge assemblies 18*b* and 18*d*. The cutting surface 140*a* is arranged for cutting into the tubular body portions 20 of both cartridge assemblies 18*b* and 18*d* simultaneously to allow the ejectors 120, 125 to penetrate further into the interior of the cartridge assemblies 18*b* and 18*d*. Alternatively, rather than forming a cutting surface 140*a* in the forward edge of the flange 140, a cutting surface may be attached to the flange 140 by any suitable means, e.g., welding or by means of one or more screws. As discussed previously, by adjusting the size of the ejectors 120, 125, the flange 140 may be utilized with cartridge assemblies having the same or different overall diameters. The third embodiment operates in substantially the same manner as described in connection with the preferred embodiment, i.e., as the ejectors 120, 125 penetrate the interior of the cartridge assemblies 18*b* and 18*d*, the cutting surface 140*a* will cut into the tubular body portions 20 of the cartridge assemblies 18*b* and 18*d* and allow the ejectors 120, 125 to penetrate further into the interior of the cartridge assemblies 18*b* and 18*d* and to prevent interference with operation of the dispensing device. Cuts created by cutting surface 140*a* are indicated at 59 in FIGS. 11 and 13.

FIGS. 14 through 16 and 16A show a fourth embodiment of the present invention wherein like reference numerals designate like parts to that described with reference to FIGS. 1 through 7. Under this fourth embodiment, a web 270 is utilized that includes a base tube 278 that is affixed to the distal end of the drive rod 40 by any suitable means, e.g., by attachment of a nut 279 to the reduced diameter free threaded end of the drive rod 40 extending through the base tube 278. As described in connection with the previous embodiments, attachment in this manner enables easy detachment of the web assembly 270 from the drive rod 40 in the event of contamination of the ejectors 120. Alternatively, the web assembly 270 could be welded to the drive rod 40 or formed as an integral part of the drive rod 40.

Figure 15:
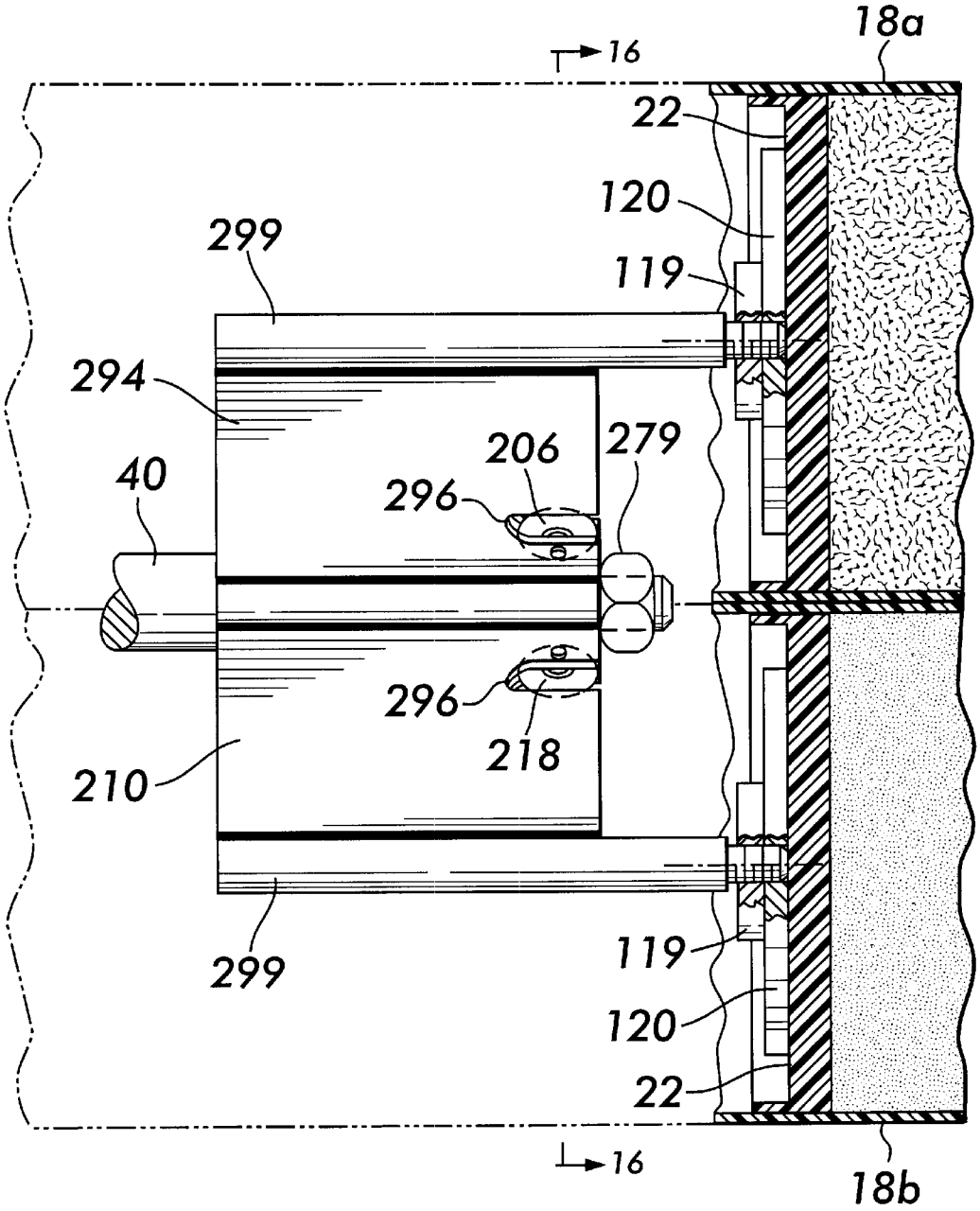
FIG. 15 is an enlarged top view of the web assembly of FIG. 14 illustrating the rotary cutting surface of FIG. 14 mounted therein.

Extending upwardly from the base tube 278 at approximately a forty-five degree angle are two sets of flanges that form a generally V-shape. As best seen in FIG. 16, the first set of flanges 290, 294, of similar length, shape and thickness and oriented parallel to one another in a spaced-apart relationship, are welded at their one end to the base tube 278 by fillet welds 298. The flanges 290, 294 extend upwardly at an approximately forty-five degree angle to the left where they are attached by any suitable means, e.g., welding, at their opposite ends to a rod-portion 299. As best seen in FIG. 15, the rod portion 299 extends in the forward ejecting direction and terminates at an ejector 120 attached thereto. The ejector 120 is sized to fit within the cup-shaped movable plunger 22 located at the rearward end of the cartridge assembly 18*a*. Likewise, a second set of flanges 210, 214 of similar length, shape and thickness, and oriented parallel to one another in a spaced-apart relationship, are welded at their one end to the base tube 278 by fillet welds 298 and extend upwardly at an approximately forty-five degree angle to the right where they are attached by any suitable means, e.g., welding, at their opposite ends to another rod-portion 299. As best seen in FIG. 15, the rod portion 299 also extends in a forward ejecting direction and terminates at an ejector 120 sized to sized to fit within the cup-shaped movable plungers 22 located at the rearward end of the cartridge assembly 18*b*.

As best shown in FIG. 16A, a circular cutting wheel 206, rotatably mounted on an axle 208, is disposed within the space between the flanges 290 and 294 and is employed to axially sever the tubular body portion 20 of the cartridge assembly 18*a*. The cutting wheel 206 may be any suitable commercial cutting wheel, e.g., a pipe-cutter. Likewise, a circular cutting wheel 218 rotatably mounted on an axle 220, is disposed within the space between the flanges 210 and 214 and is employed to axially sever the tubular body portion 20 of the cartridge assembly 18*b*. The flanges 290, 294 and 210, 214 also include opposed cutouts that form slots indicated at 296 which are arranged for receiving the tubular body portions 20 of the cartridge assemblies and for guiding them towards the circular cutting wheels 206, 218. In this manner, as the ejectors 120 penetrate the interior of the cartridge assemblies 18*a* and 18*b*, the circular cutting wheels 206, 218 will engage and cut into the tubular body portions 20 of the cartridge assemblies 18*a* and 18*b* and allow the ejectors 120 to penetrate further into the interior of the cartridge assemblies 18*a* and 18*b* and to prevent interference with operation of the dispensing device. Cuts created by the circular cutting wheels are indicated at 59 in FIGS. 14, 16 and 16A. The fourth embodiment operates in substantially the same manner as described in connection with the preferred embodiment, i.e., as the ejectors 120 penetrate the interior of the cartridge assemblies 18*a* and 18*b*, the cutting wheels 206 and 218 will cut into the tubular body portions 20 of the cartridge assemblies 18*a* and 18*b* and allow the ejectors 120 to penetrate further into the interior of the cartridge assemblies 18*a* and 18*b* and to prevent interference with operation of the dispensing device.

The present invention has been described in respect to the particular embodiments thereof set forth in the specification and as illustrated in the drawings. As a result of such disclosure, other variations and modifications may become apparent to those skilled in the art and therefore, no limitation as to the scope of the invention is intended by the specific embodiments disclosed but the scope of the invention is to be interpreted in view of the appended claims. For example, although device of the present invention has been shown and described as being various embodiments of a hand-held dispensing device, it should be understood that the device of the present invention could also be wall mounted or held within a backpack to be worn by a user wherein dispensed material flows through a tube leading from the backpack to a wand held in the hand of the user.

We claim:

1. A device for dispensing flowable materials from a plurality of cartridge assemblies, said device comprising:

a. a receptacle for carrying a plurality of cartridge assemblies therein, said cartridge assemblies each having a longitudinal axis and including a dispensing nozzle and an elongated tubular wall portion for containing a flowable material therein for dispensing, said wall portion being formed of a material that can be cut by a cutting surface;

b. a drive mechanism for moving an elongate drive rod in a direction parallel to said longitudinal axis;

c. a web assembly secured to said drive rod, said web assembly including a plurality of ejectors extending therefrom, each said ejector arranged for reciprocal movement along said longitudinal axis within one of said plurality of cartridge assemblies between a forward ejecting direction to dispense the flowable material contained therein and a return direction; and, d. at least one cutting surface disposed on said web assembly for slicing the tubular side wall of each cartridge assembly as said ejector moves in said forward ejecting direction.

2. The dispensing device of claim 1 wherein said at least one cutting surface is oriented at an angle relative to the tubular wall portion.

3. The dispensing device of claim 1 wherein said web assembly is V-shaped and comprises two flanges.

4. The dispensing device of claim 3 wherein each flange of said web assembly comprises a pair of plates oriented parallel to each other and having a space therebetween and wherein said at least one cutting surface comprises a cutting surface affixed between said plates of each flange.

5. The dispensing device of claim 4 wherein said cutting surfaces are affixed between said plates by welding.

6. The dispensing device of claim 4 wherein said cutting surfaces are affixed between said plates by use of an adhesive.

7. The dispensing device of claim 4 wherein said cutting surfaces are affixed between said plates by notches formed in the plates, said notches formed by punching.

8. The dispensing device of claim 4 wherein said cutting surfaces are integral with said plates.

9. The dispensing device of claim 4 wherein each said pair of plates includes a notch aligned with the notch of the other plate, said at least one cutting surface comprising a rotary cutting surface is disposed between said plates in proximity to said notch and arranged for rotation therein.

10. The dispensing device of claim 1 wherein said at least one cutting surface is affixed to said web assembly by a screw.

11. The dispensing device of claim 1 wherein said web assembly comprises a forward edge, said at least one cutting surface comprising a single cutting surface formed in said forward edge of said web assembly.

12. The dispensing device of claim 11 wherein two cartridge assemblies are carried by said dispensing device and wherein said single cutting surface is arranged for slicing the tubular side wall of both cartridge assemblies simultaneously.

13. The dispensing device of claim 1 wherein said ejector rams are circular and having substantially the same diameter.

14. The dispensing device of claim 1 wherein said elongate drive rod includes a forward end, said web assembly being secured to said forward end.

15. The dispensing device of claim 14 wherein said web assembly is secured to the forward end of said elongate drive rod by a nut threaded thereon.

16. The dispensing device of claim 14 wherein said web assembly is easily removable from the forward end of said elongate drive rod.

17. The dispensing device of claim 1 wherein the device is hand held.

18. A method for dispensing flowable materials from a plurality of cartridge assemblies, said method comprising:

a. providing a dispensing device having a receptacle for carrying a plurality of cartridge assemblies therein, the dispensing device having a drive mechanism for moving an elongate drive rod in a direction parallel to the longitudinal axis of the cartridge assemblies, the drive rod having affixed at its distal end a web assembly including a plurality of ejectors extending therefrom arranged for reciprocal movement within the cartridge assemblies between a forward ejecting direction to dispense the flowable material therefrom and a return direction, the web assembly having at least one cutting surface disposed thereon;

b. placing the cartridge assemblies into the receptacle of the dispensing device, the cartridge assemblies each having a dispensing nozzle and an elongated tubular wall portion formed of a material that can be cut by a cutting surface; and, c. actuating the drive mechanism to cause the at least one cutting surface to cut the tubular side wall of each cartridge assembly to permit the ejectors to move in the forward ejecting direction to dispense the flowable material from within the cartridge assemblies.

19. A device for dispensing flowable materials from a plurality of cartridge assemblies, said device comprising:

a. means for carrying a plurality of cartridge assemblies therein, said cartridge assemblies each having a longitudinal axis and including a dispensing nozzle and an elongated tubular wall portion for containing a flowable material therein for dispensing, said wall portion being formed of a material that can be cut by a cutting surface;

b. drive means for moving an elongate drive rod in a direction parallel to said longitudinal axis;

c. a web assembly secured to said drive means, said web assembly including a plurality of ejection means extending therefrom, each ejection means arranged for reciprocal movement along said longitudinal axis within one of said plurality of cartridge assemblies between a forward ejecting direction to dispense the flowable material contained therein and a return direction; and, d. disposed on said web assembly, means for slicing the tubular side wall of each cartridge assembly as said ejection means moves in said forward ejecting direction.

20. The device of claim 19 wherein said means for slicing is affixed to said web by a clamping means.

21. The device of claim 20 wherein said clamping means comprises a screw.

* * * * *